US010850209B2

(12) United States Patent
Xu

(10) Patent No.: US 10,850,209 B2
(45) Date of Patent: Dec. 1, 2020

(54) FOLDABLE WINDMILL

(71) Applicant: Ningbo Changqing Home Decor Co., Ltd., Ningbo (CN)

(72) Inventor: Ting Xu, Ningbo (CN)

(73) Assignee: Ningbo Shuosi Trading Co., Ltd., Ningbo (CN)

( * ) Notice: Subject to any disclaimer, the term of this patent is extended or adjusted under 35 U.S.C. 154(b) by 107 days.

(21) Appl. No.: 16/277,477

(22) Filed: Feb. 15, 2019

(65) Prior Publication Data

US 2020/0206648 A1 Jul. 2, 2020

(30) Foreign Application Priority Data

Dec. 27, 2018 (CN) ..... 2018 1 1607888

(51) Int. Cl.

| | |
|---|---|
| ***A63H 33/40*** | (2006.01) |
| ***F21L 4/08*** | (2006.01) |
| ***F21V 7/18*** | (2006.01) |
| ***F21V 33/00*** | (2006.01) |

(52) U.S. Cl.

CPC ..... *A63H 33/40* (2013.01); *F21L 4/08* (2013.01); *F21V 7/18* (2013.01); *F21V 33/008* (2013.01)

(58) Field of Classification Search

CPC ..... A63H 33/40; G09F 11/30; G09F 15/0062; G09F 7/18; F21V 7/18

See application file for complete search history.

(56) References Cited

U.S. PATENT DOCUMENTS

| | | | | | |
|---|---|---|---|---|---|
| 574,411 | A * | 1/1897 | Gassett | F03D 3/00 | 416/142 |
| 1,669,748 | A * | 5/1928 | Greger | A63H 33/40 | 446/218 |
| 1,906,668 | A * | 5/1933 | Valk | F03D 3/065 | 40/440 |
| 2,586,583 | A * | 2/1952 | Wagner | F21V 7/18 | 362/346 |
| 3,090,142 | A * | 5/1963 | Anderson | F03D 3/065 | 40/479 |
| 3,475,850 | A * | 11/1969 | Hop | A63H 33/40 | 446/217 |
| 3,747,263 | A * | 7/1973 | Grossberg | A63H 33/40 | 446/217 |
| 4,767,373 | A * | 8/1988 | Antonio | A63H 33/40 | 446/217 |
| 5,836,800 | A * | 11/1998 | Liu | F03D 3/00 | 446/236 |

(Continued)

*Primary Examiner* — Eugene L Kim
*Assistant Examiner* — Matthew B Stanczak
(74) *Attorney, Agent, or Firm* — Wang Law Firm, Inc.

(57) ABSTRACT

The present invention discloses a foldable pinwheel, which comprises a central pole (1); and a blade assembly rotatably disposed on the central pole (1); the blade assembly comprises a plurality of rotary blades (2) and at least one locking mechanism (4), which is rotatably disposed on the central pole (1); the plurality of rotary blades (2) can be stacked up together when the locking mechanism (4) is in an unlocked state, and the locking mechanism (4) can secure the plurality of rotary blades (2) in a stacked up position. The folding and unfolding of rotary blades are realized by a locking mechanism. The overall volume can be effectively reduced during transportation or storage. When in use, the pinwheel can be mounted quickly. It is convenient and fast.

11 Claims, 8 Drawing Sheets

(56) References Cited

U.S. PATENT DOCUMENTS 6,195,923 B1 * 3/2001 Gorman ..... G09F 11/02 40/479
6,398,615 B1 * 6/2002 Wu ..... A63H 33/40 40/440
6,678,979 B2 * 1/2004 Lim ..... G09F 19/08 40/412
7,788,835 B2 * 9/2010 Venn ..... G09F 7/22 40/604
8,523,522 B1 * 9/2013 Vanderhye ..... F03D 3/00 416/61
9,783,274 B2 * 10/2017 Greenfield ..... B63B 22/24
9,972,227 B2 * 5/2018 Evans ..... G09F 19/12
10,706,752 B2 * 7/2020 Greenfield ..... G09F 11/30
2003/0021101 A1 * 1/2003 Nelson ..... D04D 7/10 362/35
2003/0021102 A1 * 1/2003 Nelson ..... A63H 33/40 362/35
2003/0029066 A1 * 2/2003 Venn ..... G09F 15/0087 40/493
2006/0211329 A1 * 9/2006 Chang ..... A63H 33/40 446/34
2008/0145684 A1 * 6/2008 Yang ..... G09F 19/08 428/542.2
2012/0204455 A1 * 8/2012 Mothaffar ..... G09F 15/0062 40/610
2013/0252507 A1 * 9/2013 Kessler ..... A63H 33/22 446/217
2015/0343323 A1 * 12/2015 Sidwell ..... F03D 80/70 416/131
2017/0372645 A1 * 12/2017 Cross ..... G09F 7/22
2018/0015381 A1 * 1/2018 Maguire ..... B05B 3/06
2018/0015384 A1 * 1/2018 Maguire ..... A63H 33/40
2018/0119372 A1 * 5/2018 McO'Neil ..... G09F 7/10
2018/0339240 A1 * 11/2018 Maguire ..... A63H 33/40
2020/0206648 A1 * 7/2020 Xu ..... F21V 33/008

* cited by examiner

FOLDABLE WINDMILL

CROSS-REFERENCE TO RELATED APPLICATION

This application claims the benefit of priority to CN 201811607888.X, filed on Dec. 27, 2018, the entire specification of which is hereby incorporated by reference.

TECHNICAL FIELD OF THE INVENTION

The present invention relates to a wind-driven device, and in particular to a foldable pinwheel.

BACKGROUND OF THE INVENTION

Most commercially available pinwheels are constructed integrally. In other words, when in sale, pinwheel blade assemblies and other components have been fixedly mounted and cannot be disassembled for reassembly. For some pinwheels, although the stand and the pinwheel blade assemblies can be combined, the pinwheel blade assemblies that occupy most of the space still cannot be disassembled and then reassembled. As a result, the pinwheel blades are often damaged during transportation and in sale, or users discard pinwheels at will or are less willing to buy pinwheels due to the inconvenience for storage.

The present applicant has disclosed a pinwheel. The pinwheel in this patent comprises a support pole and a blade assembly. The blade assembly is coupled to the support pole. The blade assembly comprises a number of helical blades. Here, the blades cannot be detached or folded during storage or transportation, and thus it is relatively troublesome.

SUMMARY OF THE INVENTION

A first technical problem to be solved by the present invention is to provide a foldable pinwheel in view of the state of the art.

A second technical problem to be solved by the present invention is to provide a foldable pinwheel which is easy to operate.

To solve the above technical problems of the present invention, the foldable pinwheel comprises a central pole and a blade assembly rotatably disposed on the central pole; wherein, the blade assembly comprises a plurality of rotary blades and at least one locking mechanism, which is rotatably disposed on the central pole and used for securing the rotary blades; the plurality of rotary blades can be stacked up together when the locking mechanism is in an unlocked state, and the locking mechanism can secure the plurality of rotary blades in a stacked up position.

Each rotary blade is helical and has two ends, both ends connected to the central pole, and the locking mechanisms are attached to at least one end of each rotary blade.

Preferably, two locking mechanisms are disposed on the central pole, each locking mechanism is attached to one end of each rotary blade, and two ends of each rotary blade can respectively be secured with the corresponding locking mechanism.

The locking mechanisms can comprise:

a base, rotatably disposed on the central pole and having a support running through one end of the rotary blade; and a locking sleeve, capable of attaching to the support to secure one end of the rotary blade to the base.

The locking mechanisms further comprises a locking lid which is sheathed on the support, and a limiting block which is arranged on an inner side of the locking lid; a limiting slot to limit movement of the limiting block, is formed at one end of at least one of the rotary blades; the locking sleeve is locked with the support, the inner side of the locking lid gets close to and comes into contact with the rotary blade.

A first connection portion, which is flat, is formed at one end of each of the rotary blades; the first connection portions of the plurality of rotary blades are successively fitted on the support of the base; and the limiting slot is formed on each of the first connection portions. In this way, after the rotary blades are unfolded, they will not be folded due to the limiting blocks. This ensures that the rotary blades are always kept in an unfolded state.

Preferably, external locking threads are formed on the support, internal locking threads fitting with the external locking threads are formed on the locking sleeve, and a rib is arranged on the periphery of the locking sleeve.

Further, a rotatable bearing is placed on an inner side of the base and fitted on the central pole.

The inner ring of the bearing is protruded from an inner wall of the base; the central pole includes a first pole, a second pole and a joint; the first pole is arranged in the base in a first direction and is resisted against one side of the inner ring of the bearing. The second pole is arranged in the base in a second direction and rests against a first side of the inner ring of the bearing; the second pole is arranged in the base in a second direction and rests against a second side of the inner ring of the bearing; the bearing surrounds the joint, and the joint has two ends which are respectively connected to the first pole and the second pole; the first direction and the second direction are opposite with each other. A detachable structure for the central pole is mounted integrally with the base. The structure is compact and rational.

Preferably, external connecting threads are formed at both ends of the joint, internal connecting threads in fit with the external connecting threads are formed at a connection end of the first pole with the second pole.

The detachable structure for the central pole can further comprise the following arrangements: the inner ring of the bearing is protruded from the inner wall of the base; the central pole at least comprises a first pole and a second pole detachably connected to the first pole and the second pole detachably connected to the first pole; the first pole has a hollow front end, and the first pole is arranged in the base in a first direction and rests against one side of the inner ring of the bearing; a front end of the second pole further has a connection portion with a reduced caliber, and the second pole is arranged in the base in a second direction and resisted against the other side of the inner ring of the bearing; an extension portion runs through the bearing and is connected to the inner wall of the first pole; and the first direction and the second direction are opposite with each other.

To further reduce the space for mounting to ensure a folded pinwheel smaller and more compact, a second connection portion is formed at the other end of each of the rotary blades; the second connection portions of the plurality of rotary blades are successively sheathed on the support of the base; and each of the second connection portions has a groove; when the rotary blades fold toward each other, one end of the second connection portion of a front rotary blade bends inward, and one side of the second connection portion is located in the groove of the second connection portion of an adjacent rotary blade; and, one end of the second connection portion of a rear rotary blade bends outward, and the groove is resisted against one side of the second connection portion of an adjacent rotary blade; and the first connection portions of the plurality of rotary blades are superposed in the height direction.

A holder is provided on the central pole below the blade assembly, and an illuminator that emits light upward and a solar panel supplies power to the illuminator are arranged on the holder. The pinwheel can be illuminated at night or in dark, resulting in a vibrant atmosphere.

A reflective surface is formed on each of the rotary blades, or at least a portion of each of the rotary blades is light transparent. In this way, as the pinwheel rotates, light changes, resulting in a peculiar visual effect.

Compared with the prior art, in the present invention, the folding and unfolding of rotary blades are realized by a locking mechanism. The overall volume can be effectively reduced during transportation or storage. When in use, the pinwheel can be mounted quickly.

DETAILED DESCRIPTION OF THE INVENTION

To enable a further understanding of the present invention content of the invention herein, refer to the detailed description of the invention and the accompanying drawings below:

Embodiment 1

Figure 1:
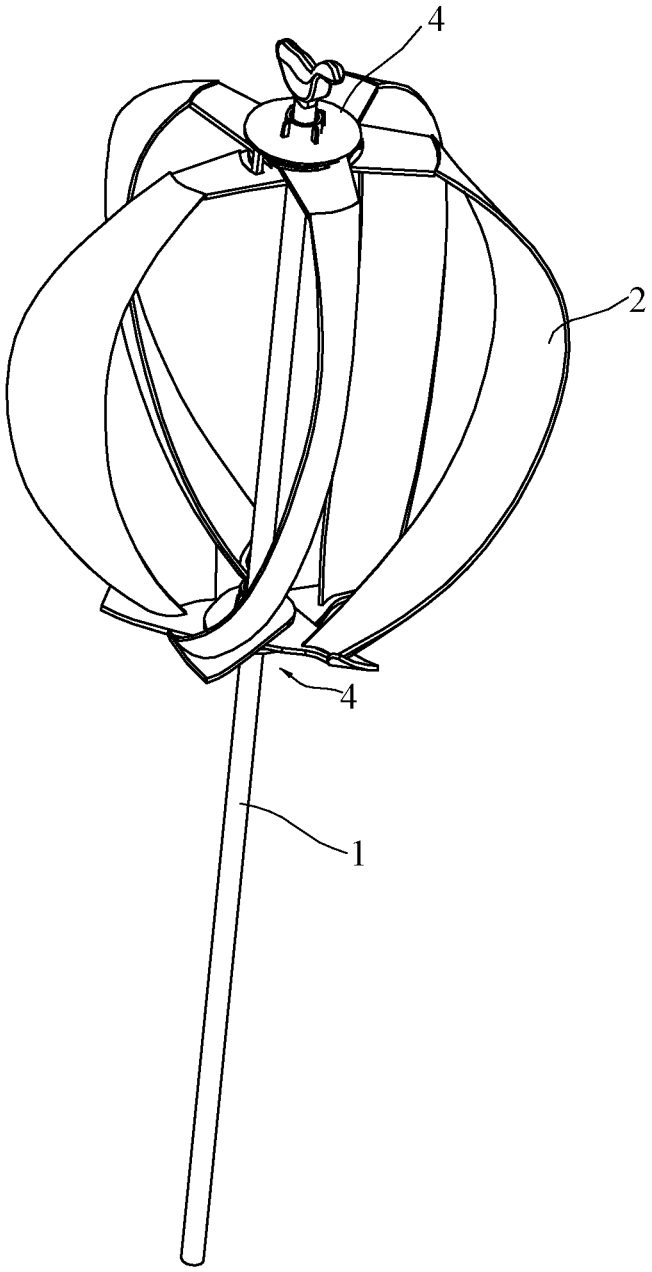
FIG. 1 is a perspective view of a foldable pinwheel according to Embodiment 1.
Figure 2:
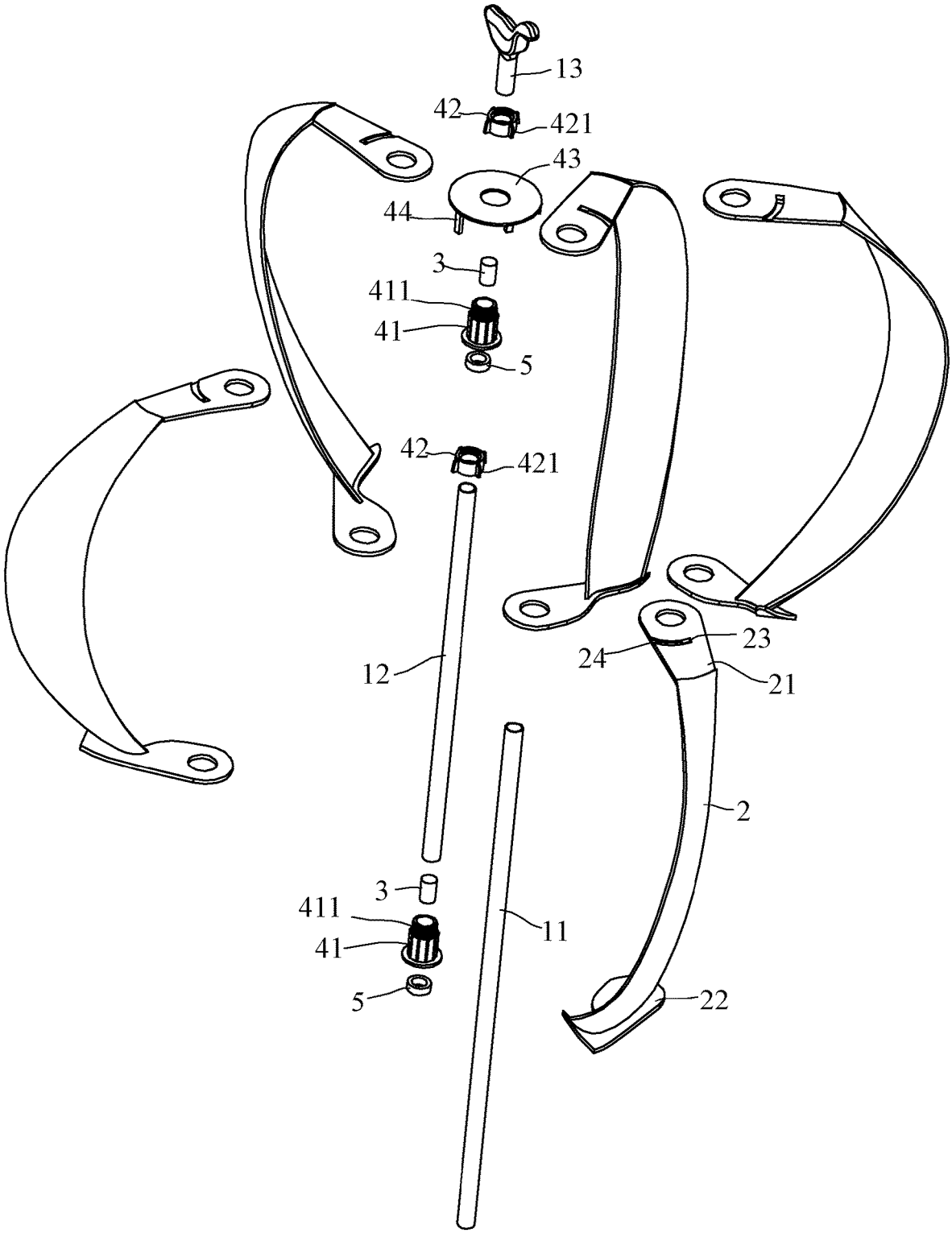
FIG. 2 is an exploded view of Embodiment 1.
Figure 3:
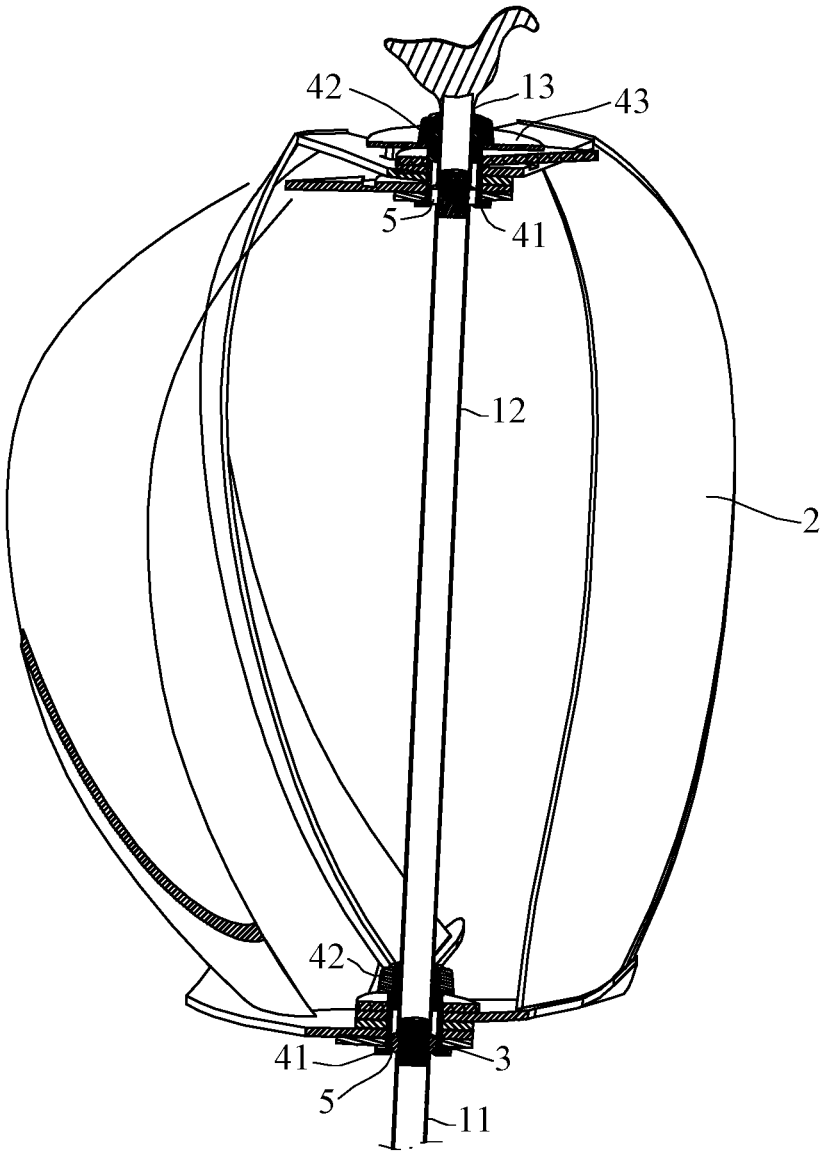
FIG. 3 is an enlarged sectional view of Embodiment 1.

As shown in FIG. 1, FIG. 2 and FIG. 3, the foldable pinwheel in this embodiment comprises a central pole 1 and a blade assembly rotatably disposed on the central pole 1. The blade assembly comprises a plurality of helical rotary blades 2 and two locking mechanisms 4 rotatably disposed at two ends of the central pole. Two ends of each rotary blades 2 can respectively be secured with the corresponding locking mechanism 4. The rotary blades 2 can be folded together when the locking mechanisms 4 are all in an unlocked state. the plurality of rotary blades 2 can be stacked up together when the locking mechanism 4 is in an unlocked state, and the locking mechanism 4 can secure the plurality of rotary blades 2 in a stacked up position.

The locking mechanism 4 at the upper end comprises a base 41, a locking sleeve 42 and a locking lid 43. The base 41 is rotatably disposed on the central pole 1 and has a support 411 running through one end of the rotary blade 2. A rotatable bearing 5 is placed on an inner side of the base 41 and fitted on the central pole 1.

The locking sleeve 42 is capable of attaching to the support 411 to secure one end of the rotary blade 2 to the base 41.

The locking lid 43 is sheathed on the support 411, and a limiting block 44 is arranged on an inner side of the locking lid 43. Correspondingly, a limiting slot 23 to limit movement of the limiting block 44, is formed at one end of at least one of the rotary blades 2. As shown in FIG. 2, a guide groove 24 is formed on one side of the limiting slot 23, so that it is convenient for the limiting block 44 to enter the limiting slot 23.

The locking sleeve 42 is locked with the support 411, the inner side of the locking lid 43 gets close to and comes into contact with the rotary blade 2.

Figure 4:
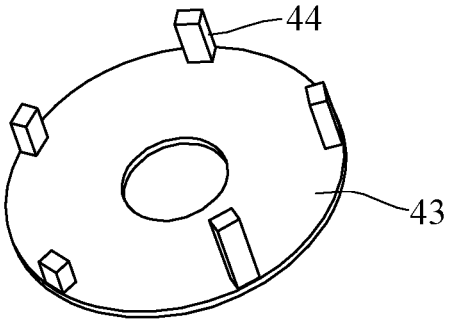
FIG. 4 is an enlarged view of a back side of a locking lid of FIG. 2.

Specifically, a first connection portion 21, which is flat, is formed at one end of each of the rotary blades 2; the first connection portions 21 of the plurality of rotary blades 2 are successively fitted on the support 411 of the base 41; and the limiting slot 23 is formed on each of the first connection portions 21. Correspondingly, as shown in FIG. 4, a number of limiting blocks 44 are arranged on the inner side of the locking lid 43 around a center of the locking lid, and the height of the limiting blocks 44 increases sequentially in a direction.

The structure for fitting the locking sleeve 42 with the base 41 is as follows: external locking threads are formed on the support 411, internal locking threads fitting with the external locking threads are formed on the locking sleeve 42, and a rib 421 is arranged on the periphery of the locking sleeve 42.

A locking lid 43 is arranged for the locking mechanism 4 at the lower end. Please refer to the locking mechanism at the upper end for other structures. An inner ring of the bearing 5 is protruded from an inner wall of the base 41. The central pole 1 includes a first pole 11, a second pole 12, a joint 3 and a third pole 13. The first pole 11 is arranged in the base 41 in a first direction and is rests against a first side of the inner ring of the bearing 5. The second pole 12 is arranged in the base 41 in a second direction and rests against a second side of the inner ring of the bearing 5. The bearing 5 surrounds the joint 3, and the joint 3 has two ends which are respectively connected to the first pole 11 and the second pole 12. The first direction and the second direction are opposite with each other.

Please refer to the structure for assembling the first pole 11 and the second pole, for the structure for assembling the third pole 13 and the second pole 12. External connecting threads in fit with the external connecting threads are formed at a connection end of the first pole 11 with the second pole 12.

Figure 5:
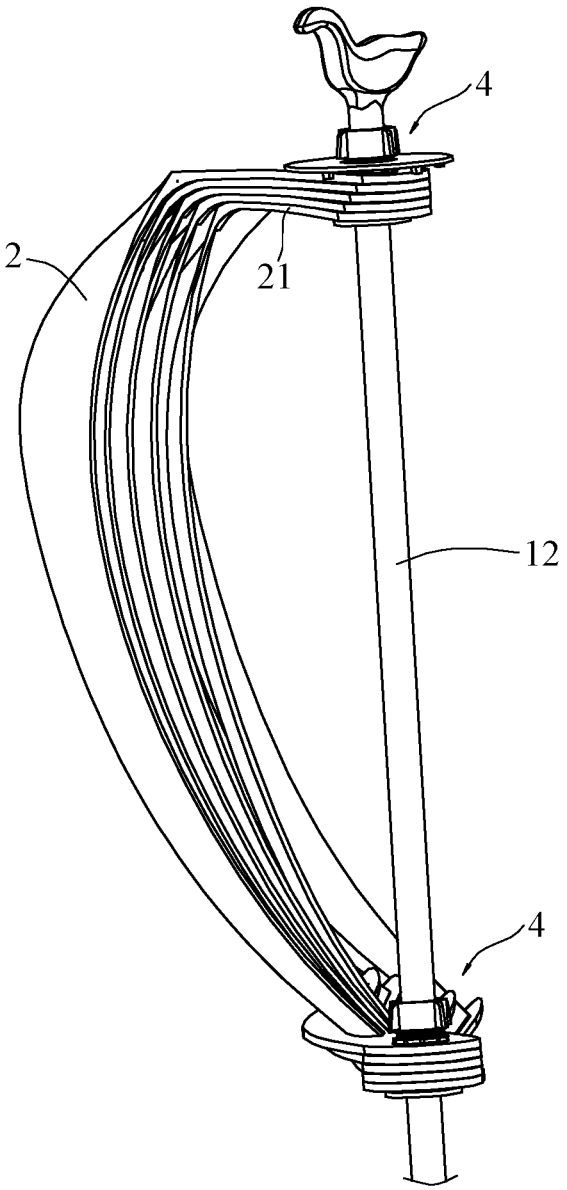
FIG. 5 is a perspective view of the foldable pinwheel according to Embodiment 1 when the foldable pinwheel is folded.
Figure 6:
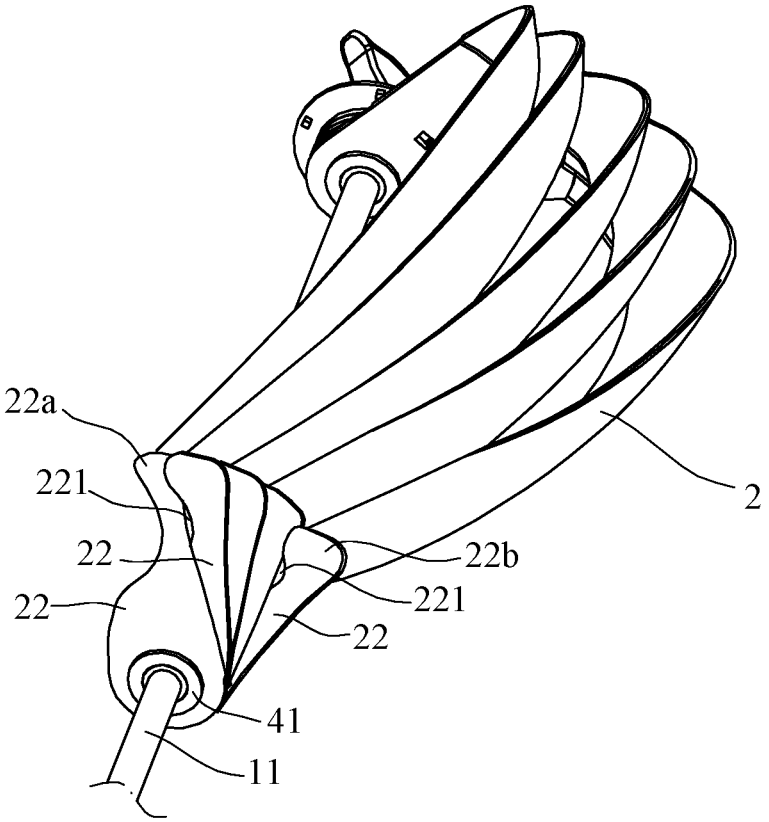
FIG. 6 is a perspective view of the foldable pinwheel according to Embodiment 1 when the foldable pinwheel is folded, viewed from another perspective.

As shown in FIG. 6, a second connection portion 22 is formed at the other end of each of the rotary blades 2. The second connection portions 22 of the plurality of rotary blades 2 are successively sheathed on the support 411 of the base 41. Each of the second connection portions 22 has a groove. When the rotary blades 2 fold toward each other, one end 22*a* of the second connection portion 22 of a front rotary blade 2 bends inward, and one side of the second connection portion is located in the groove 221 of the second connection portion 22 of an adjacent rotary blade 2; and, one end 22*b* of the second connection portion 22 of a rear rotary blade 2 bends outward, and the groove 221 is resisted against one side of the second connection portion 22 of an adjacent rotary blade 2. As shown in FIG. 5, the first connection portions 21 of the plurality of rotary blades are superposed in the height direction.

When it is to unfold the pinwheel, the locking sleeves 42 in the two locking mechanisms 4 are unscrewed, the first connection portions 21 and the second connection portions 22 at two ends of each of the rotary blades 2 are all released and unfolded, and the limiting blocks 44 on the locking lids 43 are in fit, in a limiting manner, with the limiting slots 23 on the first connection portions 21 due to the guide grooves 24. Then, the locking sleeves 42 are screwed. In this way, the rotary blades 2 are fixed and kept in the unfolded state.

When it is to fold the pinwheel, the locking sleeves 42 are released so that all blades are folded together, as shown in FIGS. 5 and 6. Of course, when it is to further detach the pinwheel, the first pole 11, the second pole 12 and the third pole can be all detached because they are all in thread-fit with the joint 3.

Embodiment 2

Figure 7:
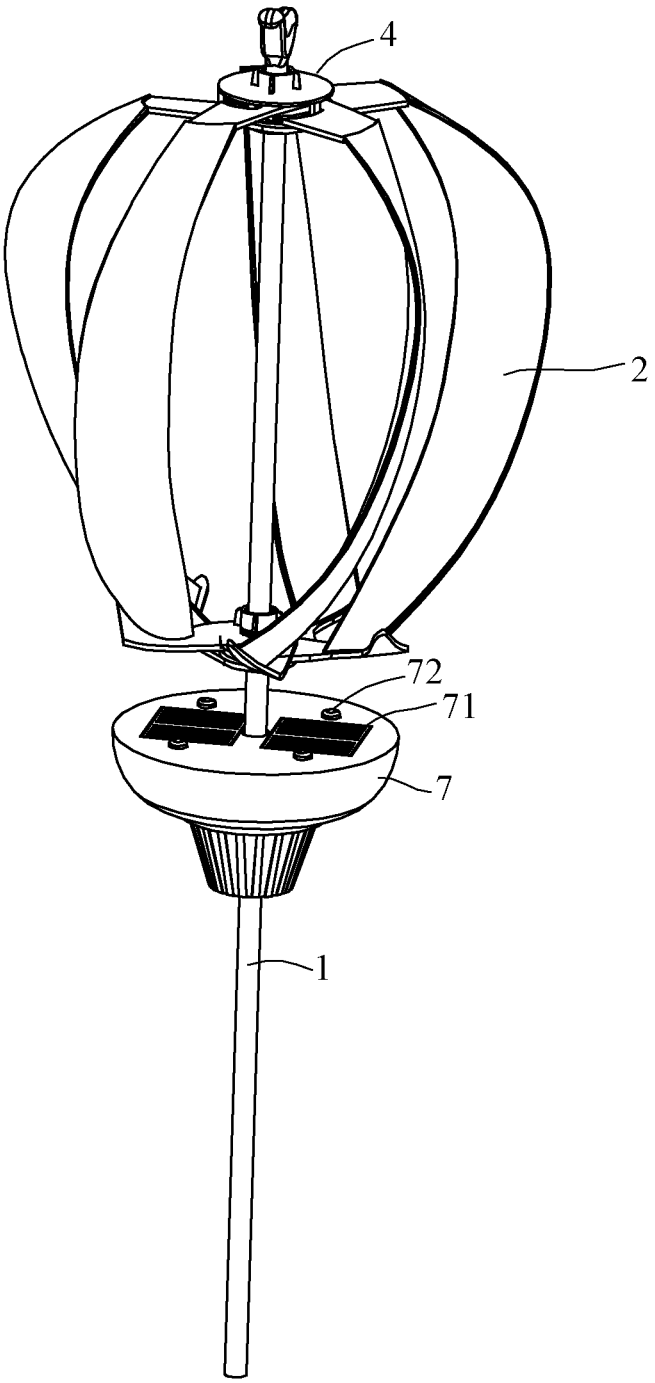
FIG. 7 is a perspective view of a foldable pinwheel according to Embodiment 2.

As shown in FIG. 7, in this embodiment, a holder 7 is provided on the central pole 1 below the blade assembly, and an illuminator 72 that emits light upward and a solar panel 71 that supplies power to the illuminator 72 are arranged on the holder 7. Here, the solar panel can be replaced with an accumulator. However, when considered from environmental protection, the solar panel is preferred. Please refer to Embodiment 1 for other structures.

Embodiment 3

Figure 8:
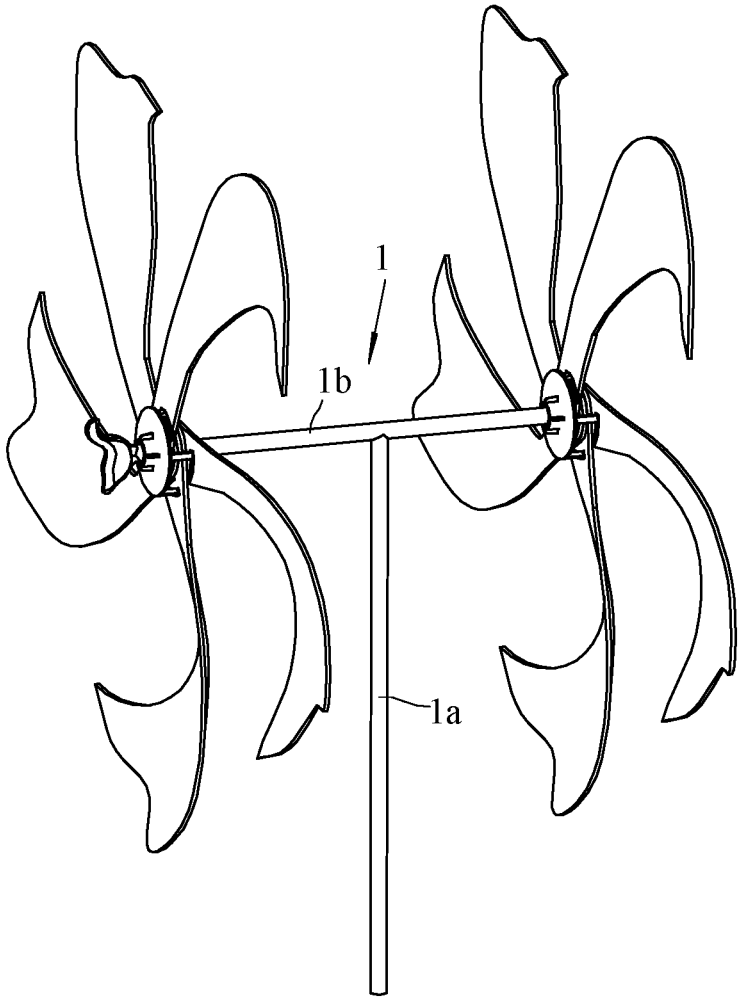
FIG. 8 is a perspective view of a foldable pinwheel according to Embodiment 3.
Figure 9:
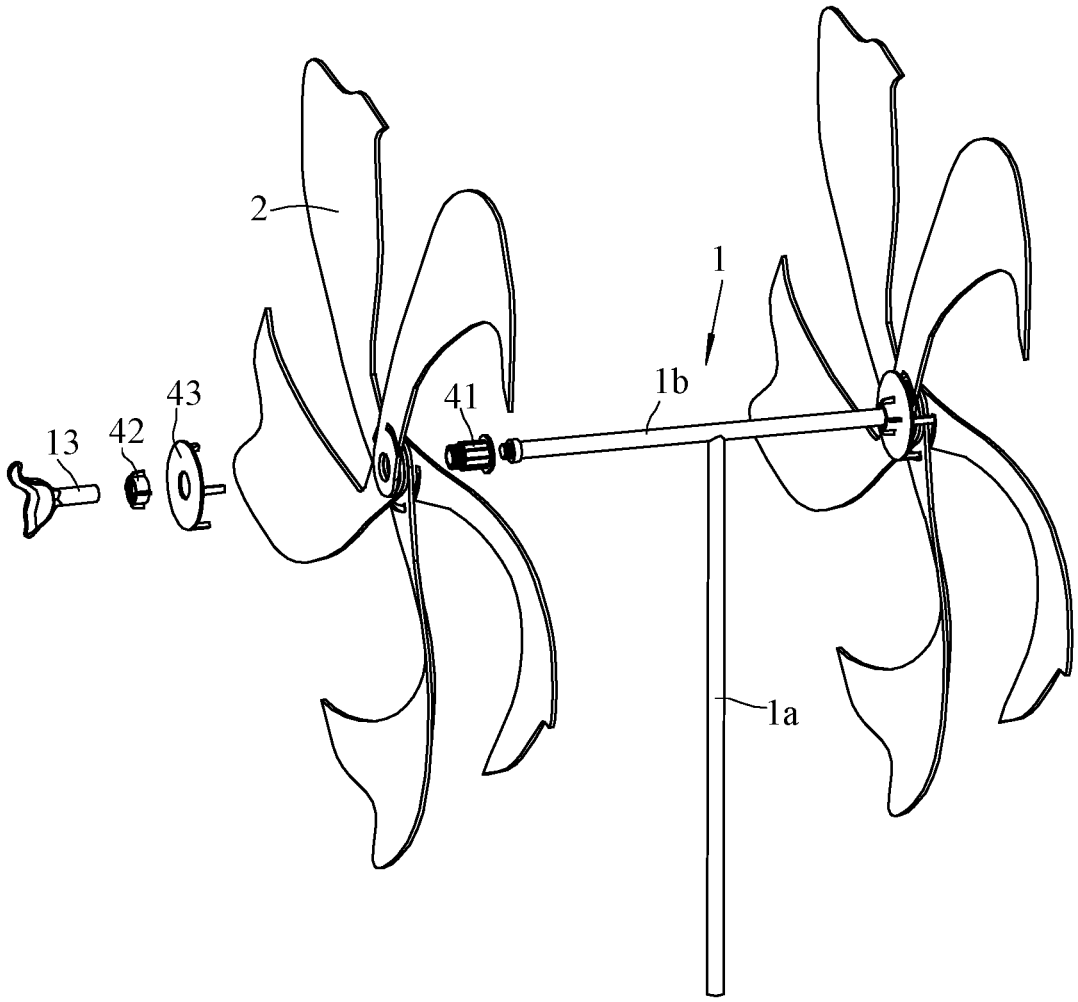
FIG. 9 is a partially exploded view of FIG. 8.

As shown in FIGS. 8 and 9, in this embodiment, the central pole 1 comprises a horizontal pole 1*a* and a vertical pole 1*b*. The horizontal pole 1*a* is arranged on the top of the vertical pole 1*b*. Two blade assemblies and respective locking mechanisms 4 are arranged at two ends of the horizontal pole 1*a*. Each of the rotary blades 2 is platy. Please refer to the arrangement shown in Embodiment 1 for the locking mechanisms 4.

The invention claimed is:

1. A foldable pinwheel, comprising:

a central pole; and a blade assembly rotatably disposed on the central pole;

wherein, the blade assembly comprises a plurality of rotary blades and at least one locking mechanism, which is rotatably disposed on the central pole and used for securing the rotary blades;

the plurality of rotary blades can be stacked up together when the locking mechanism is in an unlocked state, and the locking mechanism can secure the plurality of rotary blades in a stacked up position;

the locking mechanisms further comprise:

a base, rotatably disposed on the central pole and having a support running through one end of the rotary blade;

a locking sleeve, capable of attaching to the support to secure one end of the rotary blade to the base;

a locking lid which is sheathed on the support, a limiting block which is arranged on an inner side of the locking lid;

a limiting slot to limit movement of the limiting block, is formed at one end of at least one of the rotary blades;

the locking sleeve is locked with the support, the inner side of the locking lid gets close to and comes into contact with the rotary blade;

wherein external locking threads are formed on the support, internal locking threads fitting with the external locking threads are formed on the locking sleeve, and a rib is arranged on the periphery of the locking sleeve.

2. The foldable pinwheel of claim 1, wherein each rotary blade is helical and has two ends, both ends connected to the central pole, and the locking mechanism is attached to at least one end of each rotary blade.

3. The foldable pinwheel of claim 2, wherein two locking mechanisms are disposed on the central pole, each locking mechanism is attached to one end of each rotary blade, and two ends of each rotary blade can respectively be secured with the corresponding locking mechanism.

4. The foldable pinwheel of claim 1, wherein a first connection portion, which is flat, is formed at one end of each of the rotary blades; the first connection portions of the plurality of rotary blades are successively fitted on the support of the base; and the limiting slot is formed on each of the first connection portions.

5. The foldable pinwheel of claim 4, wherein a second connection portion is formed at the other end of each of the rotary blades; the second connection portions of the plurality of rotary blades are successively sheathed on the support of the base;

and each of the second connection portions has a groove;

when the rotary blades fold toward each other, one end of the second connection portion of a front rotary blade bends inward, and one side of the second connection portion is located in the groove of the second connection portion of an adjacent rotary blade; and, one end of the second connection portion of a rear rotary blade bends outward, and the groove is resisted against one side of the second connection portion of an adjacent rotary blade; and the first connection portions of the plurality of rotary blades are superposed in the height direction.

6. The foldable pinwheel of claim 1, wherein a rotatable bearing is placed on an inner side of the base and fitted on the central pole.

7. The foldable pinwheel of claim 6, wherein an inner ring of the bearing is protruded from an inner wall of the base; the central pole includes a first pole, a second pole and a joint;

the first pole is arranged in the base in a first direction and rests against a first side of the inner ring of the bearing; the second pole is arranged in the base in a second direction and rests against a second side of the inner ring of the bearing; the bearing surrounds the joint, and the joint has two ends which are respectively connected to the first pole and the second pole;

the first direction and the second direction are opposite with each other.

8. The foldable pinwheel of claim 7, wherein external connecting threads are formed at both ends of the joint, internal connecting threads in fit with the external connecting threads are formed at a connection end of the first pole with the second pole.

9. The foldable pinwheel of claim 6, wherein the inner ring of the bearing is protruded from the inner wall of the base; the central pole at least includes the first pole and the second pole detachably connected to the first pole; the first pole has a hollow front end, and the first pole is arranged in the base in a first direction and rests against one side of the inner ring of the bearing;

a front end of the second pole further has a connection portion with a reduced caliber, and the second pole is arranged in the base in a second direction and resisted against the other side of the inner ring of the bearing; an extension portion runs through the bearing and is connected to the inner wall of the first pole; and the first direction and the second direction are opposite with each other.

10. The foldable pinwheel of claim 1, wherein a holder is provided on the central pole below the blade assembly, and an illuminator that emits light upward and a solar panel supplies power to the illuminator are arranged on the holder.

11. The foldable pinwheel of claim 10, wherein a reflective surface is formed on each of the rotary blades, or at least a portion of each of the rotary blades is light transparent.

* * * * *